US006932256B2

(12) United States Patent
Hale et al.

(10) Patent No.: US 6,932,256 B2
(45) Date of Patent: Aug. 23, 2005

(54) BALANCED PACK

(76) Inventors: Frederick G. Hale, 56187 Pamlico Dr., Hatteras, NC (US) 27943; Laura Kaye Blume, 620 Halton Rd., #13201, Greenville, SC (US) 29607

( * ) Notice: Subject to any disclaimer, the term of this patent is extended or adjusted under 35 U.S.C. 154(b) by 122 days.

(21) Appl. No.: 10/409,767

(22) Filed: Apr. 9, 2003

(65) Prior Publication Data

US 2004/0060954 A1 Apr. 1, 2004

Related U.S. Application Data

(60) Provisional application No. 60/414,240, filed on Sep. 27, 2002.

(51) Int. Cl.[7] ..... A45C 3/04

(52) U.S. Cl. ..... 224/637; 224/640; 224/645; 224/646; 224/648; 224/649; 224/652; 224/684

(58) Field of Search ..... 224/637, 627, 224/640, 645, 646, 648, 649, 652, 664, 676, 677, 680–684, 259–263, 266, 582; 2/94, 69

(56) References Cited

U.S. PATENT DOCUMENTS

| | | | | |
|---|---|---|---|---|
| 1,426,024 A | * | 8/1922 | Thureson | 2/94 |
| 2,620,479 A | * | 12/1952 | Buck | 2/94 |
| 3,848,267 A | | 11/1974 | DeSpain | |
| 4,350,726 A | | 9/1982 | Berry, Jr. | |
| 5,072,455 A | | 12/1991 | St. Ours | |
| 5,073,985 A | | 12/1991 | Stone et al. | |
| 5,289,959 A | * | 3/1994 | Beeley et al. | 224/160 |
| 5,319,806 A | | 6/1994 | Hermann et al. | |
| 5,361,412 A | * | 11/1994 | Perry | 2/69 |
| 5,465,425 A | * | 11/1995 | Crispin | 2/102 |
| 5,497,922 A | | 3/1996 | Tate | |
| 5,586,703 A | | 12/1996 | Radar et al. | |
| 5,634,579 A | | 6/1997 | Baclawski | |
| 5,743,447 A | | 4/1998 | McDermott | |
| 5,754,982 A | | 5/1998 | Gainer | |
| 5,774,338 A | * | 6/1998 | Wessling, III | 361/730 |
| 5,799,851 A | | 9/1998 | Wulf et al. | |
| 5,909,802 A | | 6/1999 | Puco et al. | |
| 5,991,925 A | | 11/1999 | Wu | |
| 6,135,333 A | | 10/2000 | Tucker et al. | |
| 6,189,750 B1 | | 2/2001 | Von Neumann | |
| 6,343,727 B1 | * | 2/2002 | Leach | 224/158 |
| 6,397,392 B1 | | 6/2002 | Wooley et al. | |
| 6,402,003 B1 | | 6/2002 | Jackson | |
| 2001/0052532 A1 | | 12/2001 | Perez et al. | |

FOREIGN PATENT DOCUMENTS

| | | |
|---|---|---|
| DE | 8707977 U | 9/1987 |
| DE | 19603131 A | 8/1996 |

OTHER PUBLICATIONS

European Search Report, EP03450208.

* cited by examiner

*Primary Examiner*—Tri M. Mai
(74) *Attorney, Agent, or Firm*—Womble Carlyle Sandridge & Rice, PLLC

(57) ABSTRACT

A pack for carrying school books and other items, with the weight substantially balanced between the front and back of the wearer. A yoke has front and back pouches, and an opening for the wearer's head. The sides of the front and back portions of the yoke are releasably connected by flaps at the sides of the back portion which engage a strip of hook-and-loop material on the front pouch. An auxiliary bag is detachably connected to the back pouch.

1 Claim, 5 Drawing Sheets

BALANCED PACK

This application claims the benefit of Provisional Application No. 60/414,240, filed Sep. 27, 2002.

BACKGROUND OF THE INVENTION

This invention relates to a pack having a yoke with front and back pouches. By loading items to be carried into the front and back pouches, the load to be carried can be substantially balanced.

Backpacks are in widespread use by children to transport books and other heavy objects, as well as their lunches and other supplies, to and from school. These backpacks generally have a pouch or sack which rests on the child's back, and straps fitting around the child's shoulders. The newest generation of packs provides lumbar support with hip straps, sternum safety with chest straps, and upper body protection with padded, contoured shoulder straps. The weight of the pack is distributed over the user's back to capitalize on the strength of that part of the body. However, the student or the parent must adjust the straps for varying daily loads to ensure proper usage of the equipment and to ensure overall back health. This is beyond the capability of young children. Defense Department studies have shown that proper distribution of packed weight is critical to a soldier's health, and recent child studies have criticized the preset assortment of packs used to carry school supplies, especially for younger children. Concentrating the weight on the child's back can cause lumbar strain and other back injuries, as well as making the backpack unwieldy to handle.

To overcome these problems, it has been proposed that the backpack load be divided by providing a pack with pockets or compartments at the front and back, so that the load will be distributed between the front and back of the wearer. For example, U.S. Pat. No. 6,397,392 B1 to Wooley et al. discloses a pack with pockets at the front and back. The pack is in the form of a vest, with the front portion divided at the center. U.S. Pat. No. 6,402,003 B1 to Jackson discloses a pack having front and back compartments which are joined by straps across the shoulders and at the sides. Neither of these patents discloses a pack which can be quickly and easily put on by a child without having to manipulate buckles, zippers, or other such fasteners.

SUMMARY OF THE INVENTION

In the present invention, the pack includes a yoke having front, back and center portions. There is an aperture through the central portion for the head of a child or other wearer of the pack. A pouch is located on each of the front and back portions, so that school books and other items can be inserted into the front and back pouches, substantially balancing the load. Flaps extend from the sides of the back portion of the yoke and are attachable to the front portion by hook-and-loop fasteners. This allows the wearer, particularly a younger child, to easily attach the front and back portions together at the wearer's front or sides, while at the same time snugly fitting the pack to the wearer's torso and transferring some of the load from the wearer's shoulders to the torso and hip bones, without having to adjust straps or other devices to compensate for varying loads.

Thus, it is an object of the invention to provide a pack for carrying various items, particularly books and school supplies, in which the items are carried in pouches at the front and back of the wearer, thereby allowing the load to be substantially balanced, as compared to carrying the entire load on the wearer's back.

A further object of the invention is to provide a pack in the form of a yoke having front and back pouches which can be easily put on by a child or other wearer.

A further object of the invention is to provide a pack having front and back pouches in which the front and back portions of the pack are releasably attachable together at the sides by flaps which can be easily fastened and unfastened by the wearer and fit snugly around the torso of the wearer.

DETAILED DESCRIPTION OF THE INVENTION

Figure 1:
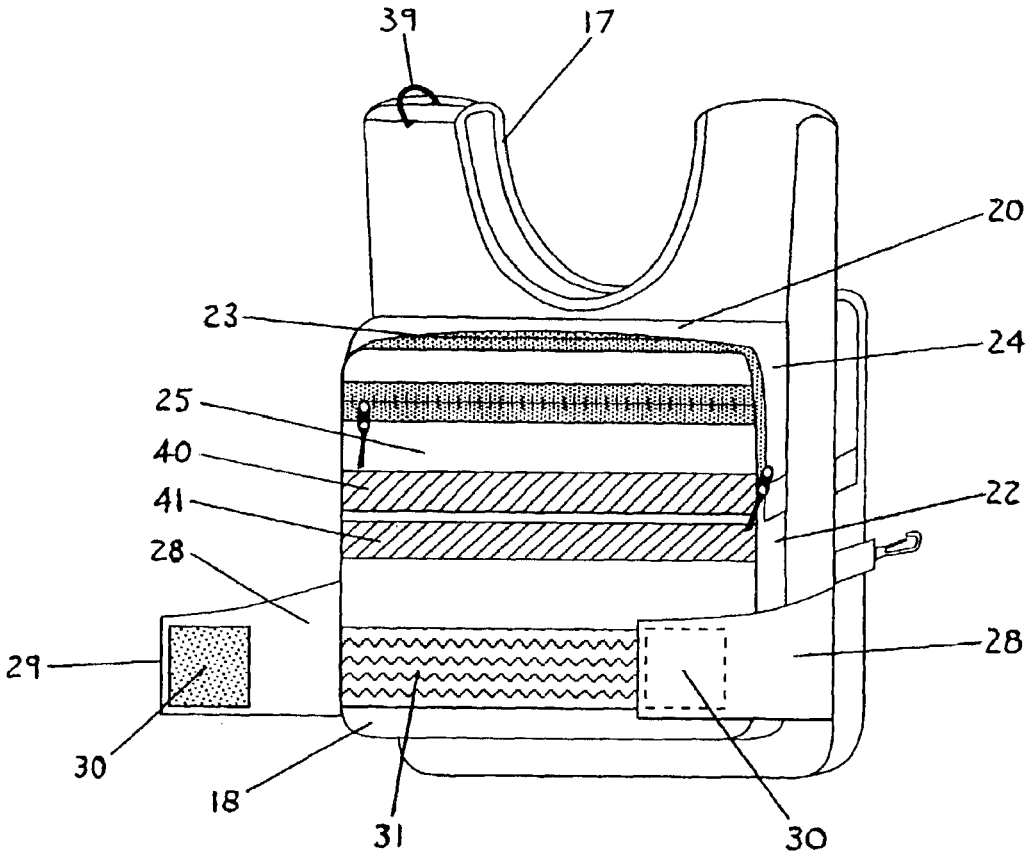
FIG. 1 is a perspective front view of the pack of our invention.
Figure 2:
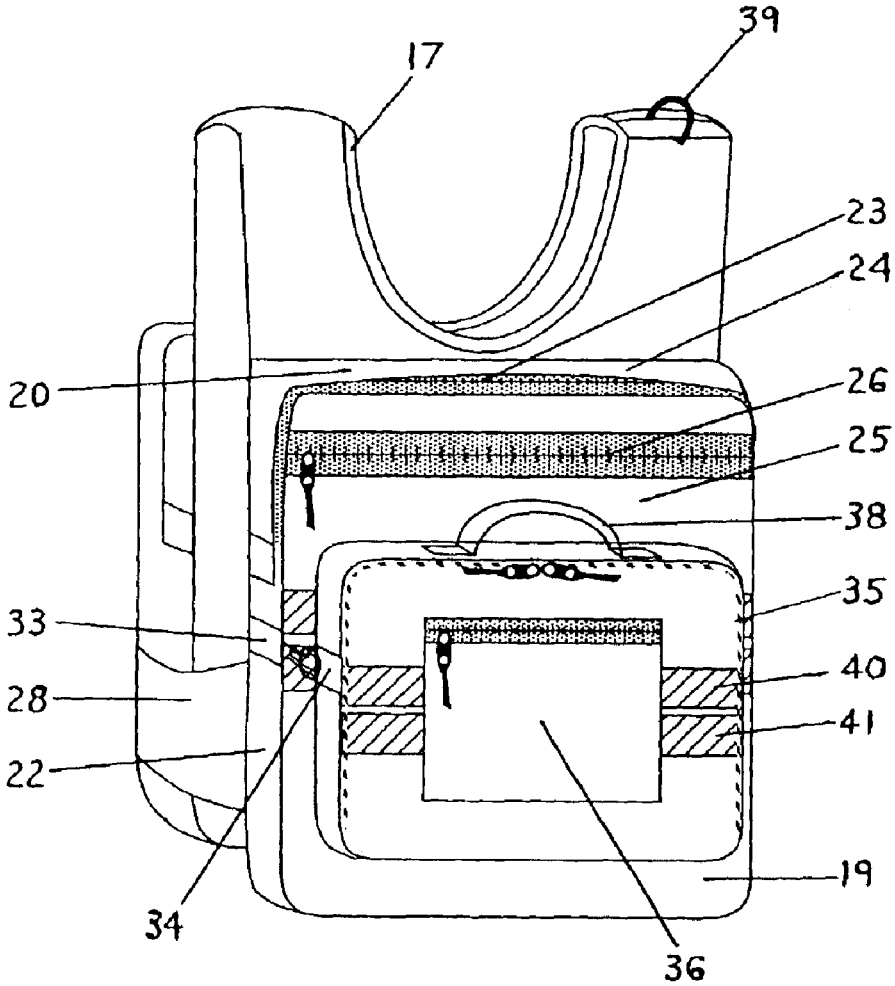
FIG. 2 is a perspective rear view of the pack of our invention, with the auxiliary bag attached.
Figure 3:
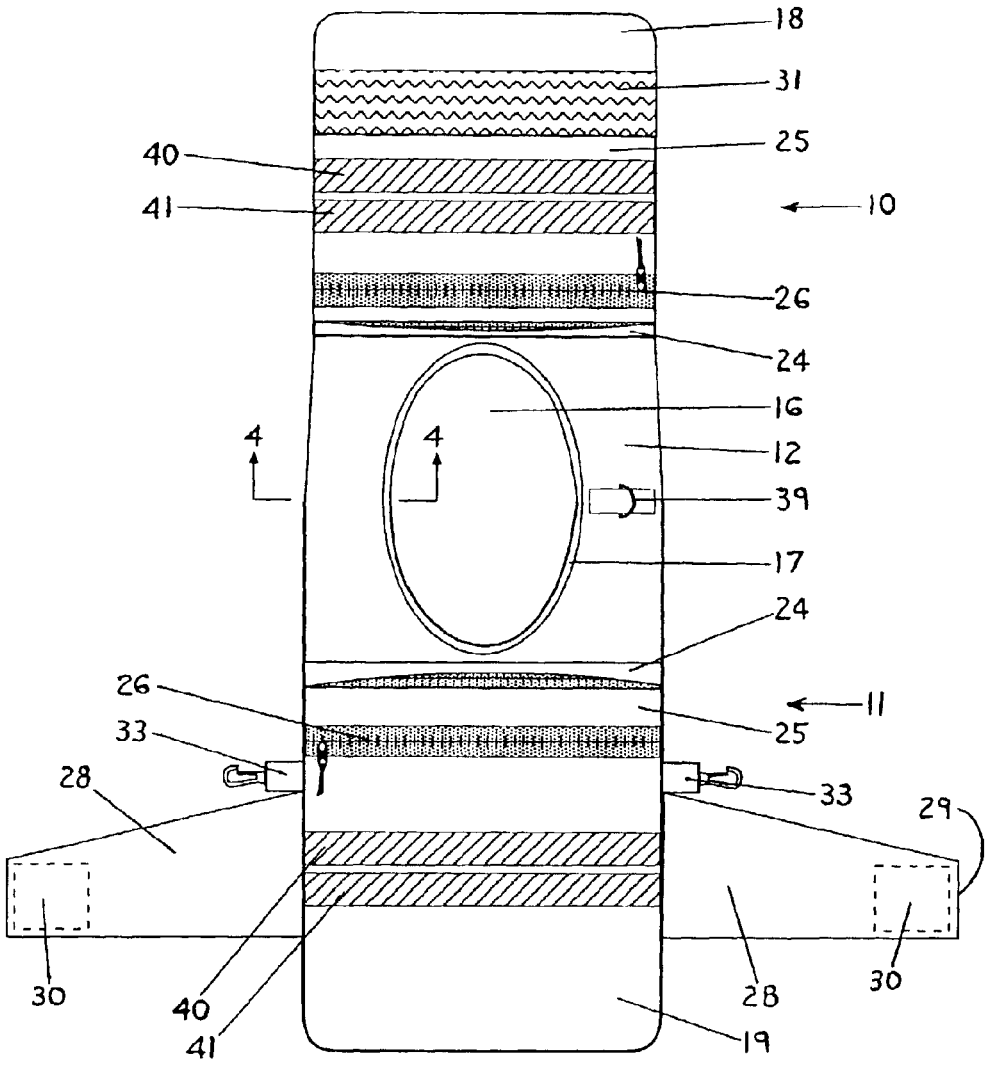
FIG. 3 is a plan view of the outer side of the pack of our invention.
Figure 4:
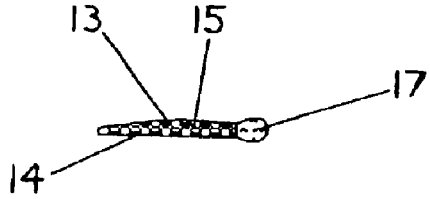
FIG. 4 is a cross-section taken on line 4—4 of FIG. 3.

Referring to FIGS. 1 to 8 of the drawings, the carrying pack of the invention has a yoke made up of a front portion 10, a back portion 11, and a central portion 12 connecting the front and back portions. These portions are approximately equal in width. As shown in FIG. 3, the front portion is slightly narrower than the back and central portions 11, 12, which are of equal width. Each portion is essentially flat and is made up of two layers 13, 14, sewn or otherwise joined together around their edges. The layers may be made of any suitable material which is of sufficient strength and flexibility, and, desirably, is water resistant. Preferably, they are made of nylon, which has the necessary qualities. Padding 15 is positioned between the layers in each of the three yoke portions.

An opening 16, shown as oval shaped in FIG. 3, extends through the central portion 12 of the yoke. This opening is made sufficiently large that a child or other wearer of the pack can insert his or head through it. Around the periphery of opening 16 is sewn or otherwise attached a fleece edging 17. This edging extends inwardly from the edge of the opening. When the pack is being worn, the fleece edging can contact the wearer's neck to prevent chafing by the material at the edge of the opening.

On the front portion 10 of the yoke is a front pouch 18, and on the back portion 11 of the yoke is a back pouch 19. Each of these pouches extends across the width of the portion of the yoke on which it is located, from one side to the other. Preferably, as shown in the drawings, each pouch is coextensive, in width and height, with the respective portion of the yoke on which it is located. In order to allow adequate room within each pouch for carrying school books and other bulky items, the pouches 18 and 19 are gusseted, that is, they each have a top panel 20, bottom panel 21 and side panels 22 to provide an adequate interior space The upper end of each pouch is open to allow access to its interior, the openings extending across the top panel 20 of each pouch and partly down each side panel 22 of the pouch. These openings are each closed by a zipper 23, or other suitable means, and the zipper is covered by a flap 24, to provide protection from the weather.

A pocket 25, also closed by a zipper 26 or other suitable fastener, may be provided on the outside of the front and back pouches 18, 19 for holding small objects. Other pockets may be provided inside or outside the pouches, as desired. Also, a padded insert 27 (FIG. 8) may be provided so that if a laptop computer is carried in the front or back pouch, it will be protected.

In order to join together the sides of the front and back portions of the yoke when the pack is in use, a back flap 28 extends from each side of the back portion. Each back flap is relatively wide at its proximal end where it is joined to the side of the back portion, and tapers to a narrower width at its free distal end 29. As shown, each back flap 28 is located intermediate the bottom edge of the back portion 11 of the yoke and the upper edge of the back pouch 19. Adjacent the distal end of each flap on its interior surface there is attached a piece 30 of hook-and-loop fastener material, such as Velcro®. A corresponding strip 31 of hook-and-loop fastener material extends across the front surface of front pouch 18, so that the flaps may be releasably attached to the front portion of the yoke by attaching pieces 30 to strip 31. Preferably, the pieces 30 are the "hook" pieces of the hook-and-loop fastener and strip 31 is the "loop" material, so that foreign objects and clothing will have less of a tendency to stick to strip 31.

Figure 5:
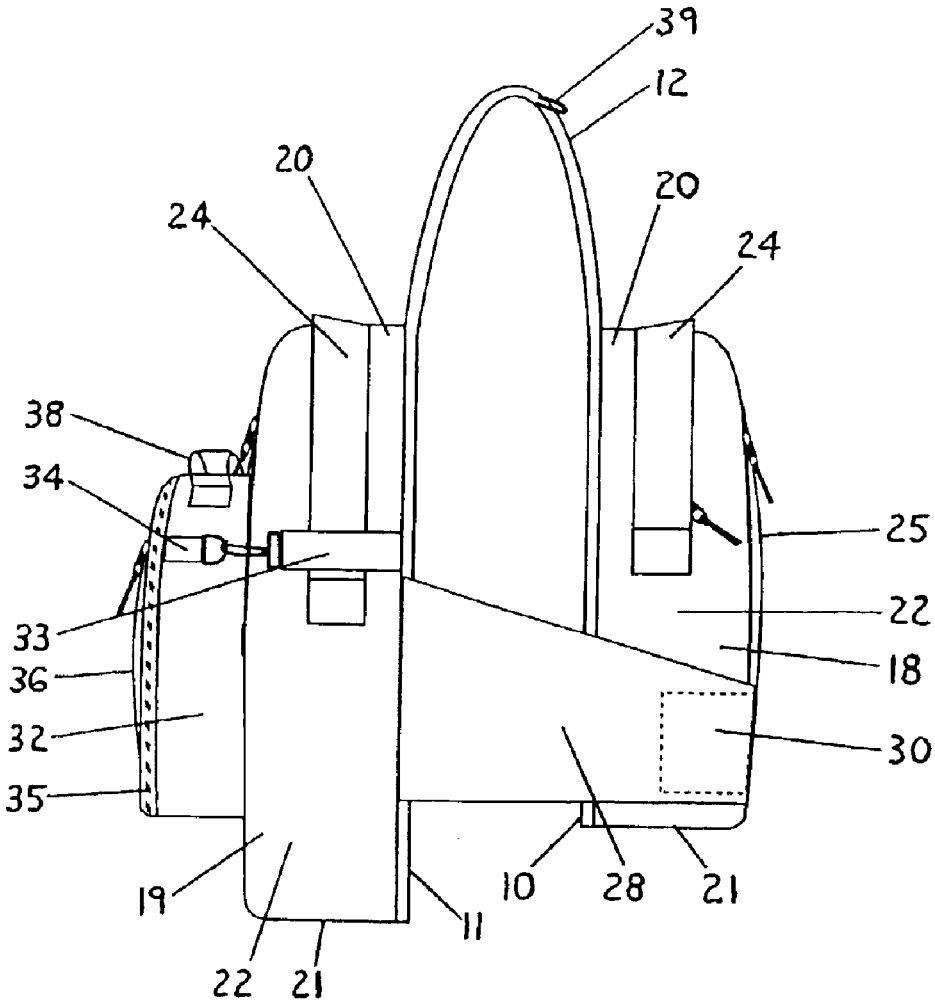
FIG. 5 is a side view of the pack, with the auxiliary bag attached.
Figure 6:
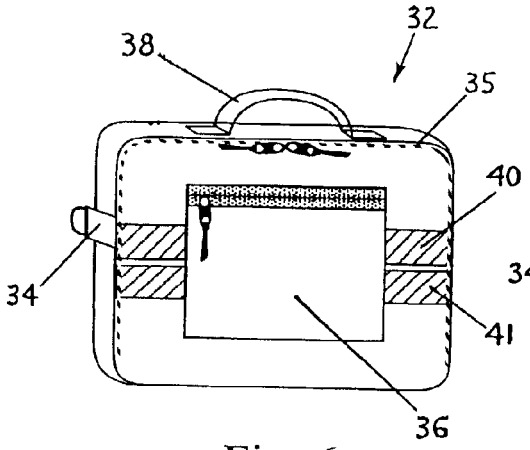
FIG. 6 is a perspective view of the outside of the auxiliary bag.
Figure 7:
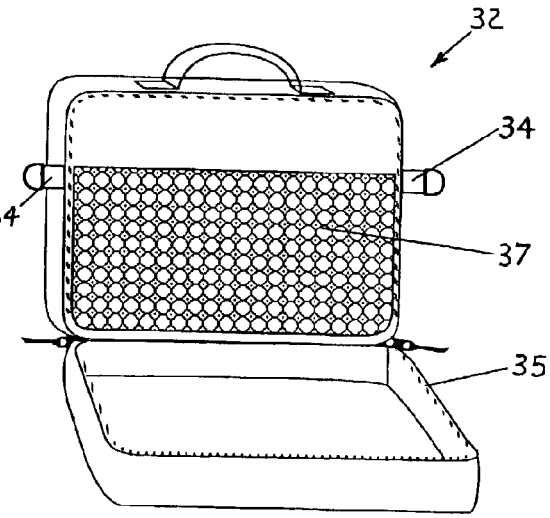
FIG. 7 is a perspective view of the inside of the auxiliary bag.
Figure 8:
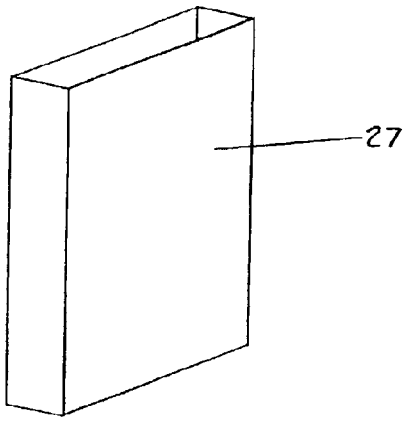
FIG. 8 is a perspective view of the padded insert for a laptop computer.

An auxiliary bag 32 may be carried on the back pouch 19. As best shown in FIGS. 2 and 5, the auxiliary bag 32 is releasably attached to the back pouch 19 by means of a snap hook which is on a short strap 33 located at each side of the back pouch, and which engages a D-ring on a short strap 34 at each side of the auxiliary pouch 32. As shown, the auxiliary bag is rectangular in shape, and has a zipper 35 or other suitable closure around three of its sides, allowing it to be opened flat. There may be a pocket 36 on the outside of the auxiliary bag, and a pocket 37, shown as made of mesh, in its interior. A handle 38 is provided for carrying the auxiliary bag 32.

A D-ring 39 may be attached to the central portion 12 of the yoke, preferably midway between the front and back portions, to allow the pack to be hung up when not in use.

One or more strips 40, 41 of reflective material may be provided on the exterior of the front and back pouches, and on the auxiliary bag 32, as desired, in order to make the wearer more visible, particularly at night or in inclement weather.

Alternatively, the front and back portions of the yoke may be joined by providing an additional pair of flaps on the sides of the front pouch, although the single pair of back flaps 28 arrangement shown in FIGS. 1 to 5 is preferred. These front flaps would be of the same configuration as back flaps 28, and each would have a piece of hook-and-loop fastener material on the exterior surface of their distal ends. The pieces on the front flaps would engage the pieces on the back flaps to join the sides of the front and back portions of the yoke.

In use of the preferred embodiment, the child or other wearer dons the pack of the invention by inserting his or her head through the opening 16 in the central portion 12 of the yoke. The front and back pouches 18, 19 hang down from the portion of the yoke situated on the wearer's shoulders, and books, school supplies and other items may be placed in the pouches 18, 19 and in the various other pockets, such as 23, provided on the pack. By providing pouches at the front and back of the wearer, the load can be substantially balanced, as compared to a conventional backpack. The width of the parts of the central portion on each side of the opening 16 spreads the load on the shoulders, and the padding 14 in the three portions of the yoke makes the pack more comfortable for the wearer.

After the pack is in place on the wearer's shoulders, the sides of the front and back portions 10, 11 of the yoke are joined by grasping the back flaps 28, pulling them around the waist, and attaching the hook-and-loop pieces 30 to the strip 31 on the front pouch 18. This arrangement allows the pack to be quickly and easily secured around the wearer's body, while simultaneously allowing a snug fit regardless of the size of the wearer's torso. This snug fit tends to transfer some of the load from the wearer's shoulders to the torso and hip bones. Children in particular are able to easily fasten and unfasten the back flaps 28 around their waists without having to manipulate buckles or similar fasteners on straps in order to fasten the straps or adjust their length to fit the wearer and/or compensate for varying loads.

A child's lunch may be carried in the auxiliary bag 32, and pencils, crayons and other items to be used during the school day may be placed in the mesh pocket 37. When the child reaches school, the pack may be hung up by D-ring 39 and the auxiliary bag 32 detached from the pack by undoing the snap hooks on straps 33. The child can then carry around the auxiliary bag during the school day, rather than the entire pack.

While the pack has been described generally with respect to its use by smaller children, it will be apparent that packs of suitably larger sizes may be advantageously used by teenagers and adults.

Although the preferred embodiment of the present invention has been described above, it is recognized that various modifications and changes may occur to those skilled in the art. Accordingly the invention is not limited to the precise construction and operation shown and described, but rather encompasses any and all embodiments, and their equivalents, within the scope of the following claims.

We claim:

1. A pack for carrying items, permitting the balancing of the load of the carried items between the front and back of the wearer, comprising:

a. a yoke having a front portion, a back portion, and a central portion connecting the upper ends of the front and back portions, each portion comprising two layers of material with padding therebetween;

b. an opening through the central portion to accommodate the head of the wearer, there being a fleece edging around the periphery of the opening, the fleece edging extending into the opening to cushion the neck of the wearer;

c. a front pouch coextensive with the front portion of the yoke, and a back pouch coextensive with the back portion of the yoke, the front and back pouches being gusseted;

d. each pouch being open at its upper end, and having a closure for the open upper end, each closure being covered by a flap;

e. a back flap extending from each side of the back portion;

f. each of said back flaps being relatively wide at its proximal end adjacent the back portion, and tapering to a narrower width at its free distal end, there being a hook-and-loop fastener with one part extending across the front surface of the front pouch and the other part adjacent the distal end of each back flap, for releasably attaching the back flaps to the front portion of the yoke, each back flap being located intermediate the bottom of the back portion of the yoke and the upper end of the back pouch;

g. an auxiliary bag, there being a snap hook at each side of the back pouch and a D-ring at each side of the auxiliary bag for releasably attaching the auxiliary bag to the back pouch; and h. a D-ring on the central portion of the yoke for hanging up the pack.

* * * * *